US008093477B1

(12) United States Patent
Twyford

(10) Patent No.: US 8,093,477 B1
(45) Date of Patent: Jan. 10, 2012

(54) MODULAR TONGUE DRUM

(76) Inventor: Jerry A. Twyford, Springfield, MO (US)

( * ) Notice: Subject to any disclaimer, the term of this patent is extended or adjusted under 35 U.S.C. 154(b) by 0 days.

(21) Appl. No.: 12/905,599

(22) Filed: Oct. 15, 2010

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS 7,446,250 B1 * 11/2008 van der Meulen ..... 84/411 R
D616,017 S 5/2010 Partridge, Jr.

OTHER PUBLICATIONS

Item # 8247751, ETSY, Inc., 55 Washington Street, Suite 512, Brooklyn, NY 11201. Eastern Hemlock Tongue Drum by Jeffrey Smith of SmithArtWorks, Dartmouth, Nova Scotia.

RockCreek Steel Tongue Drum, 1290 Bay Dale Drive #355. Arnold, Maryland 21012. Found on EBay as item# 320551085989.

Tone Drum—Metal Tongue Drum by Ile Tambor, Atlanta GA available at ETSY, Inc., 55 Washington Street, Suite 512, Brooklyn, NY 11201 as item No. 49354170.

* cited by examiner

*Primary Examiner* — Kimberly Lockett
(74) *Attorney, Agent, or Firm* — Richard L. Marsh

(57) ABSTRACT

A tongue drum percussion instrument comprises a cylindrical shell, a circular tone plate and a plurality of fasteners. The cylindrical shell has a plurality of mounting posts extending from one edge surface. The circular tone plate is a flat metal plate provided with a plurality of tongues having a specific angle between the edges. The plurality of tongues are different in length and extend inwardly from an outer peripheral edge of the flat metal plate. The tongues are separated by radial slits and have mounting holes arranged at the ends of the slits. Different lengths of open space is created between oppositely facing end faces of the tongues.

20 Claims, 3 Drawing Sheets

MODULAR TONGUE DRUM

BACKGROUND OF THE INVENTION

1. Field of the Invention

This invention relates to a musical instrument, more particularly to drums especially to a tongue drum and more specifically to a modular tongue drum which can be fitted with any one of a multiple of tone plates, each having different voicing.

2. Prior Art Statement

It is known to provide a tongue drum by cutting a plurality of different length bars into a surface of a hollowed out log. Ancient cultures used these tongue drums for communication, ceremony and likely pleasure. The bars are typically manually cut longitudinally into the surface of the log, each bar separated by a small space. Each bar must be painstakingly shaved to establish the tone. The process of creating a tongue drum from a log is extremely time consuming and provides for little margin of error. Since each tongue is tuned by a craftsman, tongue drums are largely unavailable to the general public due to the great cost. Therefore, there exists a great need for tongue drum system comprising a drum shell, a drum head, a drum head ring and a plurality of removable tone plates wherein each tone plate has different voicing. There is also a need for a tone plate wherein each note thereof is derived from primary tone of the tone plate. A need also exists for a tongue drum tone plate that is readily duplicated to give exact tones for each tongue of every tone plate thus lowering the overall cost of a tongue drum such that the general public may enjoy the joys of playing a tongue drum.

It is also known to provide a circular tongue drum crafted from a hollowed out log wherein the top of the drum is a different wood piece than the log. The tongues are formed in parallel rows in the top of the drum without a much space between in the head. For instance, see the non-patent artwork by Jeffrey Smith, Artist of SmithArtWorks, living in Dartmouth, Nova Scotia, available online from Etsy, Inc., 55 Washington Street, Suite 512 Brooklyn, N.Y. 11201, U.S.A. as item number 8247751. The need still exists for a precision made tongue drum tone plate that can be readily duplicated wherein a primary tone tongue is established and the remainder of the tone tongues are derived from the primary tone tongue. The need also still exists for a plurality of tongue tone plates of different voicing.

It is likewise known to provide a steel tongue drum which has a plurality of tongues arranged around the periphery of a drum head. The tongues are formed into the surface of the drum head which is integral with the drum shell as is common in steel drum manufacture. Additional tongues are formed into the central portion of the drum head though there is no open space between any of the tongues. The tongues are cut into, but not through the drum head as opposed to being raised or lowered dimples as in steel calypso drums. The tongues are arranged in a "cycle of fifths pattern." For instance, see non-patent document showing the RockCreek Steel Tongue Drum made by Rock Creek Steel Drums, 1290 Bay Dale Drive, #355, Arnold, Md. 21012 available for sale on the Ebay website as item #320551085989. This drum is an inverse of a common steel drum with a raised drum surface. Obviously, there exists a need for a steel tongue drum comprising a plurality of tongue tone plates that are cut through a steel plate wherein a primary tone tongue is established and all remaining tone tongues are derived from the primary tone tongue.

It is further known to provide a tongue drum fashioned into the bottom portion of a propane bottle. The drum has a plurality of tongues arranged around the periphery of the top with a centrally located hole. For instance, see non-patent literature for a Tone Drum—Metal tongue drum by Ile' Tambor, Atlanta, Ga. available for sale online from Etsy, Inc., 55 Washington Street, Suite 512 Brooklyn, N.Y. 11201, U.S.A. as item number 49354170. There is no open space between the ends of the tongues resulting in wasted material. Additionally, the tongues are cut by hand into the surface of the bottle bottom and are individually voiced by lengthening the cut alongside each tongue. Accordingly, there still is a great need for a tongue drum comprising a flat steel plate provided with a plurality of tongues of different lengths but of the same triangular shape wherein a primary tone tongue is established and the remaining tongues are derived from the primary tone tongue. There is also a great need for a drum shell having a plurality of mounting posts extending from one edge surface wherein a circular drum head comprising a flat steel plate is affixed thereto.

Finally, it is known to provide a drum shell with fingers protruding inwardly from the inner peripheral surface of the drum shell. For instance, see the U.S. Design Pat. D 616,017 issued on 18 May 2010 to Joe E. Partridge, Jr. The fingers of the drum shell are rigid and all of the same size and shape. The fingers do not produce sound and are inaccessible by the user of the drum shell when a drum head is affixed thereto. Therefore, there is still a need for a tongue drum which comprises a circular drum head, a cylindrical drum shell, a tensioning ring and a plurality of fasteners wherein the cylindrical drum shell is provided with a plurality of mounting posts extending from one edge surface which support the circular drum head. The circular drum head comprises a flat steel plate provided with a plurality of tongues of different lengths but the same base width extending inwardly from an outer periphery edge of the flat steel plate wherein the plurality of tongues are separated by radial slits extending inwardly from the outer peripheral edge to an end of each tongue thus creating variable open space between oppositely facing end faces of the tongues.

SUMMARY OF THE INVENTION

One object of this invention is to provide a tongue drum comprising a cylindrical drum shell, a tensioning ring, a tongue tone plate and a plurality of fasteners wherein the plurality of fasteners affix the tongue tone plate to one end of the drum shell and the tensioning ring affixes a conventional drum head to the other end of the drum shell.

Another object of this invention is to provide a cylindrical drum shell provided with a plurality of mounting posts extending from one edge surface of the cylindrical drum which are adapted to support a circular drum tone plate.

A primary goal of this invention is to provide a circular tongue drum tone plate which comprising a flat steel plate provided with a plurality of tongues of different lengths but of the same base width which extend inwardly from an outer periphery edge of the flat steel plate.

A significant feature of this invention is to provide a circular tongue drum tone plate comprising a plurality of tongues separated by radial slits wherein the slits extend inwardly from the outer peripheral edge to an end of each said tongue thus creating a different open space between each pair of oppositely facing end faces of said tongues.

A main purpose of this invention is to provide circular tongue drum tone plate having an outer peripheral edge provided with a plurality of mounting holes there through wherein each mounting hole is arranged adjacent an outer end of a slit provided between adjacent tone tongues of the tone plate.

A primary principle of this invention is to provide a tongue drum comprising a tongue plate with a plurality of similarly shaped tongues formed thereinto wherein the steel plate is affixed to a plurality of upstanding posts provided on one edge of a drum shell and a tensioning ring greater in diameter than a drum head to be affixed to an edge of said drum shell opposite an edge thereof carrying the tongue plate wherein the tensioning ring provided with a plurality of holes through an outer rim thereof wherein the plurality of fasteners are disposed through the holes in the tensioning ring and fastened into a plurality of mounting lugs disposed on, and extending outwardly from an outer peripheral surface of said drum shell.

A principal aim of this invention is to provide a tongue drum comprising a cylindrical drum shell, a tensioning ring, a tongue tone plate and a plurality of fasteners wherein the plurality of fasteners affix the tongue tone plate to one end of the drum shell.

A primary aspect of this invention is to provide a plurality of tongue tone plates which are adapted to be affixed to one end of a drum shell wherein the drum shell has a plurality of upstanding posts on at least one surface thereof wherein fasteners are passed through one tongue tone plate into fastener holes provided in the upstanding posts.

DESCRIPTION OF THE PREFERRED EMBODIMENTS

Figure 1:
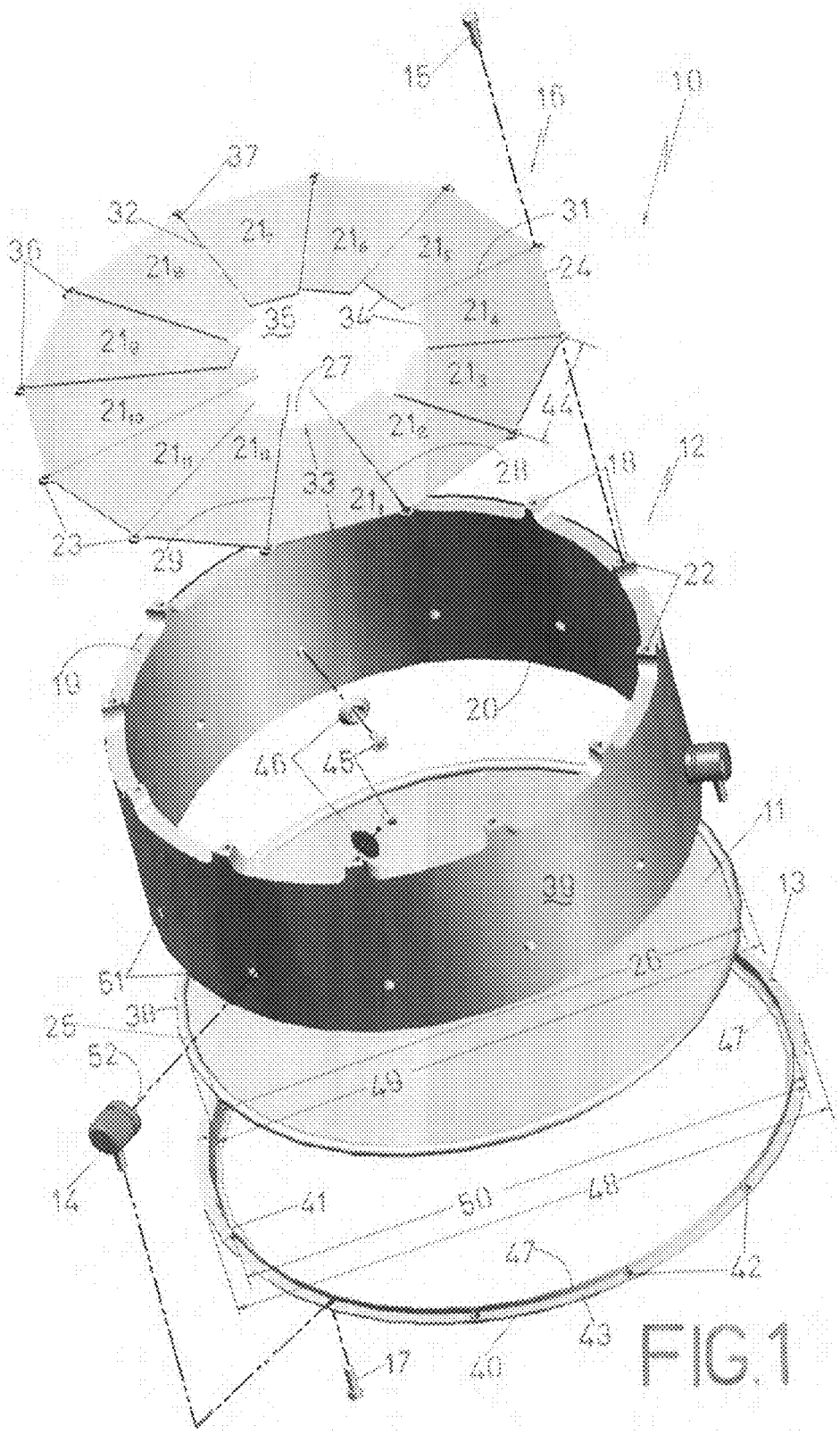
FIG. 1 is an exploded perspective view of the preferred embodiment of the tongue drum of this invention.
Figure 2:
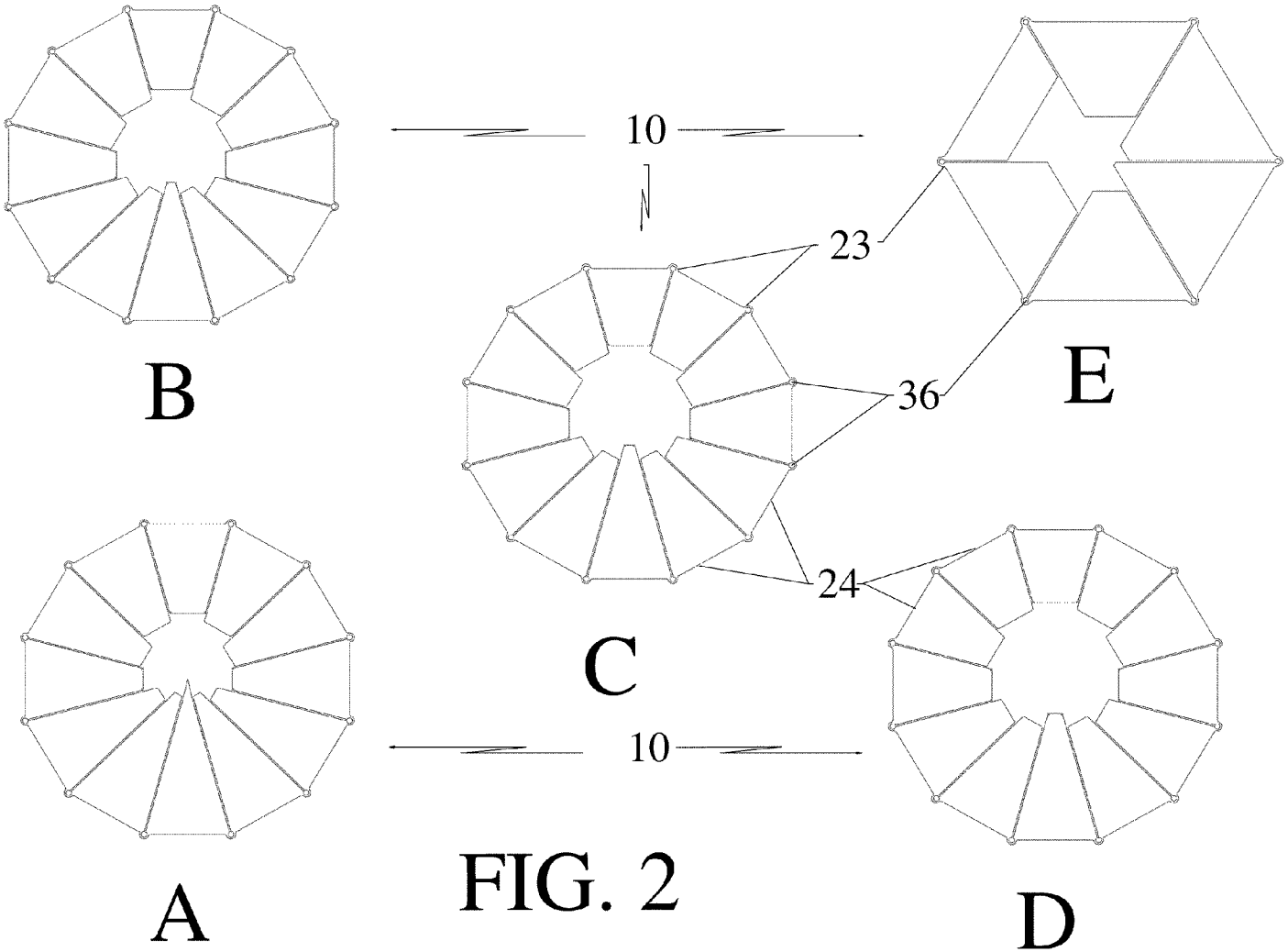
FIG. 2 is a top plan view of a plurality of tone plates of this invention

Referring now to FIG. 1, a tongue drum, generally shown by the numeral 10, comprises a circular drum head 11, a cylindrical drum shell 12, a tensioning ring 13, a plurality of drum lugs 14, a first plurality of fasteners 15, a circular tone plate 16 and a second plurality of fasteners 17. Cylindrical drum shell 12 is provided with a plurality of mounting posts 18 that extend from one edge surface 19 of cylindrical drum shell 12 wherein the opposed edge surface 20 of cylindrical drum shell 12 may also be provided with mounting posts 18, however opposed edge surface 20 is preferably of conventional construction. Circular tone plate 16 comprises a flat steel plate provided with a plurality of tongues $\mathbf{21}_{1\text{-}n}$ having a specified angle 27 between side edges 28, 29 shown on tongue $\mathbf{21}_1$ only. Plurality of tongues $\mathbf{21}_{1\text{-}n}$ have the same base width 44 at an outer peripheral edge 30 but are of different lengths $\mathbf{33}_{1\text{-}n}$ and extend inwardly from outer peripheral edge 30 of the flat steel plate. Plurality of tongues $\mathbf{21}_{1\text{-}n}$ are separated by radial slits 31, 32 shown adjacent side edges 28, 29 of tongue $\mathbf{21}_{1\text{-}n}$ slits 31, 32 extending inwardly from outer peripheral edge 30 to an end face 34 of each tongue $\mathbf{21}_{1\text{-}n}$ thus creating open space 35 between oppositely facing end faces 34 of tongues $\mathbf{21}_{1\text{-}n}$. Outer peripheral edge 30 is provided with a plurality of bosses 23 protruding outwardly therefrom, bosses 23 provided with mounting holes 36 therethrough, mounting holes 36 arranged adjacent an outer end 37 of each slit 31, 32. Between bosses 23 of tone tongues $\mathbf{21}_{1\text{-}n}$ is a chord 24 the function of chord 24 becoming readily apparent hereinafter. Plurality of mounting holes 36 for each diameter of tongue tone plate 16 are provided at a diameter commensurate with plurality of mounting posts 18 of drum shell 12. As drum shell 12 preferably has twelve mounting posts 18, tongue tone plate 16 of twelve tongues $\mathbf{21}_{1\text{-}n}$ is secured to all mounting posts 18 of drum shell 12 with first plurality of fasteners 15. However, where circular tone plate 16 has fewer than twelve tongues $\mathbf{21}_{1\text{-}n}$, certain mounting posts 18 are skipped and therefore circular tone plate 16 having fewer than twelve tongues $\mathbf{21}_{1\text{-}n}$ is affixed to mounting posts 18 of drum shell 12 with first plurality of fasteners 15 equal in number to mounting holes 36. For instance, tongue tone plate 16 as shown in FIG. 2 E would be mounted to every other mounting post 18 of drum shell 12. Thus, chord 24 of each tone tongue $\mathbf{21}_{1\text{-}n}$ does not contact mounting post 18 thus providing for the pure designed vibration of tone tongue $\mathbf{21}_{1\text{-}n}$ from bosses 23 to end faces 34. Likewise, if drum shell 12 is provided with twenty-four mounting posts 18, tongue tone plate 16 of FIG. 2E would be mounted to every fourth mounting post 18 while tongue tone plates 16 of FIGS. 2A-2D would be mounted to every other mounting post 18 while chords 24 of each of tone tongues $\mathbf{21}_{1\text{-}n}$ would clear the remaining mounting posts 18 of drum shell 12. Additionally, drum shell 12 with twelve mounting posts 18 can support a tongue tone plate 16 having twelve, six, four, three or two tongues 21 on mounting posts 18 while mounting posts 18 between bosses 23 are skipped and do not touch chord 24. Where drum shell 12 has twenty-four mounting posts 18, tongue tone plates 16 of twenty four, sixteen, twelve, eight, six, four, three or two tongues 21 may be mounted wherein chords 24 between bosses 23 do not contact the intervening mounting posts 18. Of course, it is within the scope of this invention to utilize drum shell 12 of greater or fewer mounting posts 18 with tongue tone plates 16 manufactured therefor.

Circular drum head 11 has an outer peripheral rim 38 that is generally a round bead 25 formed around circular drum head 11 wherein bead 25 has an inside diameter 26 substantially equal in diameter to an outer peripheral surface 39 of drum shell 12. Tensioning ring 13 has an inner lip 47 with an outside diameter 48 thereof substantially equal to an outer diameter 49 of bead 25 of outer peripheral rim 38 and an inner diameter 50 slightly greater than outer peripheral surface 39 of drum shell 12, inner diameter 50 provided with an inner surface 41 to capture bead 25 between inner surface 41 and outer peripheral surface 39 of drum shell 12. Tensioning ring 13 is provided with a plurality of holes 42 through an outer flange 43 thereof wherein second plurality of fasteners 17 are disposed through holes 42 in outer flange 43 of tensioning ring 13 and are fastened into plurality of drum lugs 14 disposed on and extending outwardly from outer peripheral surface 39 of drum shell 12. Tensioning ring 13 is a commonly available item at musical and/or drum outlets.

Figure 3:
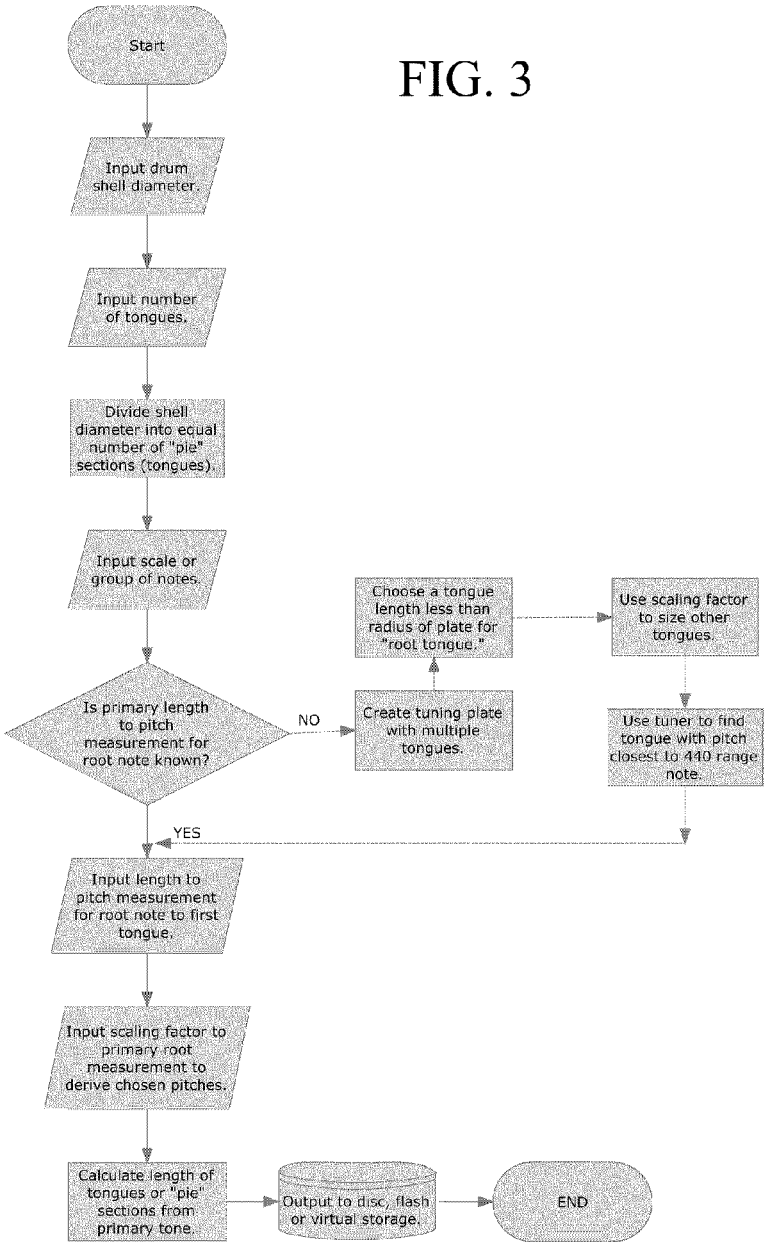
FIG. 3 is flow chart for one process of making the tone plates of FIG. 2.
Figure 3:
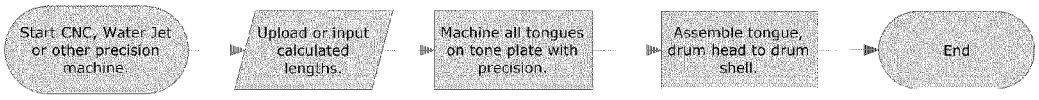

Jointly considering FIGS. 1-3, as can be readily observed in FIG. 2, an angle 27 shown in FIG. 1 is first established by dividing a circular steel plate to be used for tongue tone plate 16 into the desired number of tone tongues $\mathbf{21}_{1\text{-}n}$ for the particular tongue tone plate 16. Thus, all tongues $\mathbf{21}_{1\text{-}n}$ have an equal base width 44 and are of the same angle 27 between side edges 28, 29. Note in FIG. 2 that there are four tongue tone plates 16 of twelve tone tongues $\mathbf{21}_{1\text{-}n}$ and one tongue tone plate 16 of six tone tongues $\mathbf{21}_{1\text{-}n}$. Any one of the plurality of circular tone plates 16 of FIG. 2 A-E are exchangeable with tongue tone plate 16 affixed to mounting posts 18 of drum shell 12. Additionally each of the plurality of circular tone plates 16 of FIGS. 2A-E may have a different primary tone. In FIG. 2E, the six tone tongues $\mathbf{21}_{1\text{-}n}$ all have angle 27 between side edges 28, 29 of 60 degrees while the twelve tone tongues $\mathbf{21}_{1\text{-}n}$ of FIG. 2 A-D have angle 27 of 30 degrees. Though FIG. 2 shows only tongue tone plates 16 of six or twelve tone tongues $\mathbf{21}_{1\text{-}n}$, it is fully understood that tongue tone plate 16 may have any number of tone tongues $\mathbf{21}_{1\text{-}n}$ wherein angle 27 between side edges 28, 29 will be equal to 360 degrees divided by the number of tone tongues $\mathbf{21}_{1-n}$. Likewise, it is fully understood that the diameter of tongue tone plate 16 may be large enough to accommodate a great number of tone tongues $\mathbf{21}_{1-n}$. The length 33 of a primary tone tongue $\mathbf{21}_1$ is then determined according to the thickness of the steel plate used for tongue tone plate 16 and the vibration characteristics of a cantilevered mass of a given length as can readily be determined from vibration theory. Since each tone tongue $\mathbf{21}_{1-n}$ has the same base width 44, length 33 of longest tone tongue $\mathbf{21}_{1-n}$ can only be equal to one half the diameter of tongue tone plate 16. Though any number of tone tongues $\mathbf{21}_{1-n}$ may be cut into tongue tone plate 16, preferably circular tone plate 16 has at least two tongues $\mathbf{21}_{1-n}$.

Tone tongues $\mathbf{21}_{1-n}$ are preferably tuned to primary tone tongue $\mathbf{21}_1$ and may be arranged in ascending sequence around tongue tone plate 16 randomly, clockwise or counterclockwise and may be arranged stepwise in ascending order at intervals as desired. Thus, tongue drum 10 may have tongue tone plate 16 of six tongues $\mathbf{21}_{1-n}$ wherein tones of the of six tongues $\mathbf{21}_{1-n}$ are a scale or separated at major, perfect or minor intervals. Similarly, circular tone plate 16 of twelve tongues $\mathbf{21}_{1-n}$ may also be separated by half steps, thus making a full scale, or at second through seventh intervals. Preferably, tongues $\mathbf{21}_{1-n}$ are equally tempered where the tones of successive tongues 21 are at equal ratios to the previous tone however, tone tongues 21 may be provided in harmonic series. It is within the scope of this invention to arrange tone tongues $\mathbf{21}_{1-n}$ counterclockwise, randomly or in any arrangement as selected by the user.

Circular tone plate 16 is preferably selected from the group of rigid materials consisting of metals, thermoplastics, wood, carbon fiber, stone, glass, fibrous materials and composites or combinations thereof. More specifically, circular tone plate 16 is derived from a flat sheet of material selected from the group consisting of iron, steel, tin, aluminum, stainless steel, copper, zinc, titanium and alloys thereof and most preferably from a flat sheet of stainless steel. Tone tongues $\mathbf{21}_{1-n}$ may each be derived empirically as is well known in the art, however, a primary tone for one of tone tongues $\mathbf{21}_{1-n}$ is preferably calculated according to vibration of a cantilevered mass and all other tone tongues $\mathbf{21}_{1-n}$ are derived from the primary tone as set forth above.

Referring now to FIG. 3, selection of a primary tone for one of tone tongues $\mathbf{21}_{1-n}$ must be done in order to make a circular tone plate 16. Since different thicknesses, hardness and types of materials are available for circular tone plate 16 as well as different diameters of drum shell 12, these parameters will have an effect upon selection of the primary tone. Following the program shown in FIG. 3, the tone drum maker selects a drum shell diameter, thus establishing the diameter of tongue tone plate 16. Although there are a number of different drum shell diameters the standard snare drum shell diameter of 14 inches is a default diameter. The tone drum maker inputs the shell diameter into the program and then inputs the number of tongues desired by the tone drum maker of a specific client. The program of FIG. 3 then divides the drum shell diameter into an equal number of "pie" shaped elements defining tone tongues $\mathbf{21}_{1-n}$ which defines angle 27 between side edges 28, 29 for all tone tongues $\mathbf{21}_{1-n}$. Next, the tone drum maker inputs a musical scale or the group of notes to be applied to tone tongues $\mathbf{21}_{1-n}$. Since each scale or group of notes will have a primary tone, the program next needs the length to pitch measurement for primary tone tongue $\mathbf{21}_1$. If the length to pitch measurement for primary tone tongue $\mathbf{21}_1$ is not known, the program calculates length 33 of primary tone tongue $\mathbf{21}_1$ within the standard 440 range following the subroutine. It is best to create a tuning tone plate of a plurality of tongues similar to tongue tone plate 16 and tune the tongues with a tuning instrument to equal tones in a chromatic step. Thus, all tuning tone tongues will be approximately the same length. Since a drum shell 12 with twelve mounting posts 18 is most common, twelve tuning tone tongues are created, each tongue slightly less than the radius of the tuning tone plate. One tongue is chosen as a root tongue and a scaling factor is used to set the length of the remaining tuning tone tongues of the tuning tone plate. Though dividing the chromatic step into twelve increments is indicated, dividing into eight increments is chosen because the square root of the inverse of 1.0595 is the ratio for a chromatic half step. Thus the scaling factor for dividing the chromatic half step into eight equal divisions is the inverse of 1.0595 to the $4^{th}$ power. As twelve tongues are available, one and one-half musical half steps are then available for tuning. Since a chromatic step may be divided into any number of increments including "cents," the incremental change barely discernable by the trained musical ear, it is within the scope of this invention to scale the remaining tongues in increments of eight "cents" or any other number of increments as dictated by drum shell diameter or as desired by the tongue tone plate maker. After making a tuning tone plate and scaling all the tongues according to the scaling factor chosen, a tuner is used to find the length of the tongue on the plate closest to a true pitch in the 440 range. The length of that tongue is then input to the program for calculating the remaining tongues in tongue tone plate 16. Though it is preferred to establish a tuning tone plate according to the above steps it is within the scope of this invention to create the tuning tone plate, tune one tongue to a perfect pitch and scale the remaining tongues to the perfect pitch, thus reversing the last two steps in the subroutine in FIG. 3. If the length to pitch measurement for primary tone tongue $\mathbf{21}_1$ is known, it is input into the program.

After determining the length to pitch measurement of primary tone tongue $\mathbf{21}_1$, the scaling factor, e.g., half steps, major thirds, minor fourths for the chosen pitches is input to the program and the program calculates lengths $\mathbf{33}_{2-n}$ of all successive tone tongues $\mathbf{21}_{2-n}$. Since all information is electronically derived in the program, the output of the program is preferably put into a storage device such as a hard drive, flash drive or into virtual storage for later retrieval, however, the output may be directly put into an automatic production machine such as a Computer Controlled Machine or a high pressure water jet cutting machine from which the plate is machined into the selected number of tone tongues $\mathbf{21}_{1-n}$ at the length 33 calculated by the program. If the preferred storage device is selected, a machining operation is conducted at a later time wherein the precision machine is started, data uploaded from virtual storage or the data storage device inserted into the machine. The precision machine then cuts all tongues $\mathbf{21}_{1-n}$ on the tongue tone plate 16 and, after deburring side edges 28, 29, end faces 34 and mounting holes 36, tongue tone plate 16 is affixed to drum shell 12 with first plurality of fasteners 15 inserted through mounting holes 36 and into threaded holes 22 in mounting posts 18 on edge surface 19 of drum shell 12. Assembly of tongue drum 10 is then completed by placing circular drum head 11 over opposite edge 20 of drum shell 12 and secured thereto with tensioning ring 13 affixed to drum shell 12 with second plurality of fasteners 17 passed through plurality of holes 42 in flange 43 and into drum lugs 14. Drum lugs 14 are previously secured to drum shell 12 through holes 51 in outer peripheral surface 39 thereof with conical washers 46 fitted in holes 51 and aligned with threaded receivers 52 of drum lugs 14 and secured thereto by post nuts 45.

Tongue drum 10 may be a percussion instrument which comprises cylindrical shell 12, tongue tone plate 16 and first plurality of fasteners 15 wherein cylindrical shell 12 is provided with plurality of mounting posts 18 extending from one edge surface 19 thereof. Tongue tone plate 16 comprises a flat plate of a selected material which is provided with a plurality of tongues $\mathbf{21}_{1\text{-}n}$ having a specific angle 27 between side edges 28, 29 thereof. Preferably, plurality of tongues $\mathbf{21}_{1\text{-}n}$ are of different lengths 33 and extended inwardly from outer peripheral edge 30, plurality of tongues $\mathbf{21}_{1\text{-}n}$ separated by radial slits 31, 32 wherein slits 31, 32 extend inwardly from outer peripheral edge 30 to inner face 34 of each tongue $\mathbf{21}_{1\text{-}n}$ thus creating open space 35 between oppositely facing end faces 34 of tongues $\mathbf{21}_{2\text{-}n}$, open space 35 varying between successive opposed pairs of tongues $\mathbf{21}_{2\text{-}n}$ as each opposed pair of tongues $\mathbf{21}_{1\text{-}n}$ are different in length 33 from other opposed pairs. Outer peripheral edge 30 is provided with plurality of mounting holes 36 there through, mounting holes 36 arranged adjacent outer end 37 of each slit 31, 32 wherein plurality of mounting holes 36 is equal in number to plurality of mounting posts 18 and first plurality of fasteners 15. Tongue tone plate 16 is affixed to mounting posts 18 of drum shell 12 with first plurality of fasteners 15, however, drum head 11 is not affixed to opposite side edge 20 of drum shell 12.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A tongue drum comprises a circular drum head, a cylindrical drum shell, a tensioning ring, a plurality of drum lugs, a first plurality of fasteners, a circular tone plate and a second plurality of fasteners, said cylindrical drum shell provided with a plurality of mounting posts extending from one edge surface of said cylindrical drum shell, said circular tone plate comprising a flat steel plate provided with a plurality of tongues having a specified angle between side edges thereof, said plurality of tongues being of different lengths and extending inwardly from an outer periphery edge of said flat steel plate, said plurality of tongues separated by radial slits, said slits extending inwardly from said outer peripheral edge to an end of each said tongue thus creating open space between oppositely facing end faces of said tongues, said outer peripheral edge provided with a plurality of mounting holes there through, said mounting holes arranged adjacent an outer end of each said slit, said plurality of mounting holes equal in number to said plurality of mounting posts and said second plurality of fasteners, said circular tone plate affixed to said mounting posts of said drum shell with said second plurality of fasteners, said circular drum head having an outer peripheral rim equal in diameter to an outer peripheral surface of said drum shell, said tensioning ring having an outer periphery greater in diameter than said circular drum head and an inner periphery equal in diameter to said outer peripheral rim of said circular drum head, said tensioning ring provided with a plurality of holes through an outer rim thereof, said first plurality of fasteners disposed through said holes in said tensioning ring and fastened into said plurality of drum lugs disposed on a periphery and extending outwardly from an outer surface of said drum shell.

2. A tongue drum as in claim 1 wherein said circular tone plate has at least two tongues.

3. A tongue drum as in claim 2 wherein said circular tone plate has six tongues.

4. A tongue drum as in claim 3 wherein tones of said six tongues are at major third intervals.

5. A tongue drum as in claim 4 wherein said six tongues are arranged with said major third intervals ascending clockwise around said outer peripheral edge of said flat steel plate.

6. A tongue drum as in claim 4 wherein said six tongues are arranged with said major third intervals ascending counterclockwise around said outer peripheral edge of said flat steel plate.

7. A tongue drum as in claim 4 wherein said six tongues are randomly arranged around said outer peripheral edge of said flat steel plate.

8. A tongue drum as in claim 3 wherein tones of said six tongues are at perfect fifth intervals, said tongues are arranged with said major third intervals ascending counterclockwise around said outer peripheral edge of said flat steel plate.

9. A tongue drum as in claim 2 wherein said circular tone plate has twelve tongues.

10. A tongue drum as in claim 9 wherein tones of said twelve tongues are at major third intervals, said tongues arranged with said major third intervals ascending clockwise around said peripheral edge.

11. A tongue drum as in claim 7 wherein tones of said twelve tongues are at perfect fifth intervals, said tongues arranged with said perfect fifth intervals ascending clockwise around said peripheral edge.

12. A percussion instrument comprises a cylindrical shell, a circular tone plate and a plurality of fasteners, said cylindrical shell provided with a plurality of mounting posts extending from one edge surface of said cylindrical shell, said circular tone plate comprising a flat metal plate provided with a plurality of tongues having a specific angle between side edges thereof, said plurality of tongues being of different lengths and extending inwardly from an outer peripheral edge of said flat metal plate, said plurality of tongues separated by radial slits, said slits extending inwardly from said outer peripheral edge to an end of each said tongue thus creating open space between oppositely facing end faces of said tongues, said outer peripheral edge provided with a plurality of mounting holes there through, said mounting holes arranged adjacent an outer end of each said slit, said plurality of mounting holes equal in number to said plurality of mounting posts and said plurality of fasteners, said circular tone plate affixed to said mounting posts of said drum shell with said plurality of fasteners.

13. A percussion instrument as in claim 12 wherein said flat metal plate is selected from the group of materials consisting of iron, steel, tin, aluminum, stainless steel, copper, zinc, titanium and alloys thereof.

14. A percussion instrument as in claim 13 wherein said flat metal plate is stainless steel.

15. A percussion instrument as in claim 14 wherein said tongues are arranged around said periphery of said circular tone plate, said tones of said tongues tuned in harmonic series.

16. A percussion instrument as in claim 14 wherein said tongues are arranged around said periphery of said circular tone plate, said tones of said tongues equally tempered.

17. A percussion instrument as in claim 12 wherein said any one of a plurality of circular tone plates are exchangeable with said tone plate affixed to said mounting posts.

18. A percussion instrument as in claim 17 wherein said plurality of circular tone plates have a different primary tone.

19. A tongue tone plate comprises a flat plate provided with a plurality of tongues having a specific angle between side edges thereof, said plurality of tongues being of different lengths and extending inwardly from an outer peripheral edge of said flat plate, said plurality of tongues separated by radial slits, said slits extending inwardly from said outer peripheral edge to an end of each said tongue thus creating open space between oppositely facing end faces of said tongues, said outer peripheral edge provided with a plurality of mounting holes there through, said mounting holes arranged adjacent an outer end of each said slit, said plurality of mounting holes receiving a plurality of mounting posts of a drum shell therethrough, said plurality of mounting holes equal in number to said plurality of mounting posts, said plurality of mounting posts receiving a plurality of fasteners upon open ends thereof, said plurality of fasteners equal in number to said mounting posts, said tongue tone plate affixed to said mounting posts of said drum shell with said plurality of fasteners.

20. A tongue drum as in claim 19 wherein said flat plate is selected from the group of rigid materials consisting of metals, thermoplastics, wood, carbon fiber, stone, glass, fibrous materials and composites or combinations thereof.

* * * * *